US009222232B1

(12) United States Patent
Showalter

(10) Patent No.: US 9,222,232 B1
(45) Date of Patent: Dec. 29, 2015

(54) MATERIAL DISPENSING VEHICLE WITH MATERIAL WETTING APPARATUS

(71) Applicant: David N. Showalter, Alexandria, IN (US)

(72) Inventor: David N. Showalter, Alexandria, IN (US)

( * ) Notice: Subject to any disclaimer, the term of this patent is extended or adjusted under 35 U.S.C. 154(b) by 0 days.

(21) Appl. No.: 14/538,061

(22) Filed: Nov. 11, 2014

(51) Int. Cl.

| | |
|---|---|
| ***E01H 10/00*** | (2006.01) |
| ***B05B 13/00*** | (2006.01) |
| ***B05B 13/02*** | (2006.01) |
| ***B05B 15/04*** | (2006.01) |

(52) U.S. Cl.
CPC ..... *E01H 10/007* (2013.01); *B05B 13/005* (2013.01); *B05B 13/0278* (2013.01); *B05B 15/04* (2013.01)

(58) Field of Classification Search
CPC ..... E01H 10/007; E01C 2019/2055; B05B 13/02; B05B 13/005; B05B 13/0278; B05B 15/04
USPC ..... 239/662, 663
See application file for complete search history.

(56) References Cited

U.S. PATENT DOCUMENTS

| | | | | |
|---|---|---|---|---|
| 4,955,538 | A * | 9/1990 | Laube et al. | 239/1 |
| 5,186,396 | A | 2/1993 | Wise et al. | |
| 5,501,403 | A | 3/1996 | van Vooren | |
| 5,931,393 | A | 8/1999 | Alsip et al. | |

* cited by examiner

*Primary Examiner* — Christopher Kim
(74) *Attorney, Agent, or Firm* — Crossley Patent Law

(57) ABSTRACT

A material dispensing vehicle with a material wetting apparatus includes a rubber spray nozzle having an input valve portion and an output valve portion. The input valve portion is attached to a liquid dispenser nozzle of a vehicle. The output valve portion includes a plurality of fluid evacuation holes. The spray nozzle is adjustably mounted on a spray nozzle mount having each of a mounting bracket, an alignment bracket, and a pair of adjustment supports. The mounting bracket and the alignment bracket are disposed on a hinge. The pair of adjustment supports retain the alignment bracket at an angle relative the mounting bracket. The vehicle includes a spinner spreader having a rotary element configured to centrifugally disperse a material onto a road. The spray nozzle is configured to disperse a volume of a liquid onto the material prior to the material coming into contact with the spinner spreader.

12 Claims, 5 Drawing Sheets

MATERIAL DISPENSING VEHICLE WITH MATERIAL WETTING APPARATUS

BACKGROUND OF THE INVENTION

Various types of vehicles having material dispensing systems for preventing the accumulation of snow and ice on roads are known in the prior art. These systems generally dispense a material onto the road that has been pre-wet with a brining liquid. Pre-wetting the material prevents the material, generally in the form of salt, sand, or a combination thereof, from bouncing off of the road as it is dispensed. Pre-wetting also facilitates dissolution of salt material, releasing heat, and preventing accumulation upon roads. Many pre-wetting agents are known in the prior art, such as that produced by K-Tech Specialty Coatings, Inc. and traded under the trademark Beet Heet® Concentrate.

Many of the prior art material dispensing vehicles utilize material spreaders with integrated wetting systems that are exceedingly complex. The complexity of these prior art systems drives up the costs of repair in the event that a component of the system breaks down. Further, many of these systems include a material spreader and a material wetting system fully integrated into one complex system such that it is impossible to change the direction of the dispensation of a liquid pre-wetting agent in a manner that prevents clumping of the material into a slush prior to the material being dispensed from the material spreader. Clumping is a particular problem as it can result in clogging and jamming of the material spreader. These systems lack the ability to modify the orientation of the wetting system such that the material is wetted just prior to the material coming into contact with the material spreader preventing conversion of the material into a slush.

Other prior art material dispensing vehicles have material spreaders and material wetting systems that are not fully integrated into one system. In these vehicles, there lacks sufficient means to mount a liquid spray pre-wetting system in an adjustable manner enabling a user to direct a spray at the material so that it hits the material just prior to the material coming into contact with the material spreader.

In both fully integrated systems and non-integrated systems there lacks a spray nozzle mount apparatus that allows a user to modify the orientation of a spray nozzle of the material wetting system, thus, enabling a user a means to better direct the flow of a liquid from the material wetting system. Thus, what is needed is material dispensing vehicle with material wetting apparatus including a rubber spray nozzle and an adjustable spray nozzle mount for modifying the orientation of the spray nozzle enabling a user the means to better direct the flow of a liquid from the material wetting system so as to prevent clumping of the material into a slush.

FIELD OF THE INVENTION

The present invention relates generally vehicles with material spreaders, for example, vehicles that spread salt, sand, or salt and sand mixtures onto roads to prevent accumulation. More particularly, the invention relates to a material dispensing vehicle with an adjustable material wetting apparatus to pre-wet the material prior to the material coming into contact with a material spreader.

SUMMARY OF THE INVENTION

The general purpose of the present material dispensing vehicle with material wetting apparatus, described subsequently in greater detail, is to provide a material dispensing vehicle with a material wetting apparatus which has many novel features that result in a material dispensing vehicle with a material wetting apparatus which is not anticipated, rendered obvious, suggested, or even implied by prior art, either alone or in combination thereof.

The present device includes a rubber spray nozzle having an input portion and an output portion. The input portion includes each of a threaded hose attachment and a first input channel. The first input channel is furcated into a plurality of output channels at a furcating point. The output portion includes one of a fluid evacuation hole for each respective one of the plurality of output channels. The threaded hose attachment is in operational communication with a liquid dispenser nozzle of a vehicle. The output portion is depicted in the figures as being flattened and obround, however other shapes are suitable such as a rounded shape.

The device further includes a spray nozzle mount having each of a mounting bracket, an alignment bracket, and a mirror pair of adjustment supports. The mounting bracket has an upper end, a lower end, and a plurality of mounting apertures. A hinge is disposed upon the upper end. The alignment bracket has a first end and a second end. The first end is disposed upon the hinge. The alignment bracket and the mounting bracket are in operational communication at the hinge.

A mirror pair of pivot pins is medially disposed upon each of a proximal side surface and a distal side surface of the mouting bracket. Each respective of the pair of adjustment supports have an adjustment slot. Each respective of the pair of pivot pins are disposed within one of the respective adjustment slots. Each respective of the pair of the adjustment supports are secured to the mounting bracket by one respective of the pair of pivot pins. Additionally, each respective of the pair of adjustment supports is configured to rotate about one respective of the pair of pivot pins.

A mirror pair of threaded members are disposed upon each of a first side surface and a second side surface of the alignment bracket. Each respective of the pair of threaded members is disposed within one of the respective adjustment slots of the pair of adjustment supports. Each of the resepective threaded members is secured within one of the respective adjustment slots by one respective of a pair of wing nuts. A pair of washers is disposed between each respective wingnut and the alignment bracket and are retained one of the respective threaded members.

The device further includes a U-shaped clamp having a mirror pair of clamp threaded members. The alignment bracket has a mirror pair of alignment slots, wherein each of the respective clamp threaded members is disposed within one respective of the pair of alignment slots. A mirror pair of nuts secure each clamp threaded member within each alignment slot. The input portion of the spray nozzle is configured to fit within the clamp and between each of the pair of clamp threaded members and the alignment bracket. The spray nozzle is removably disposed within the clamp of the spray nozzle mount.

A spreader is mounted onto the vehicle and is shown in the figures as a spinner spreader, although other types of spreaders are envisionsed that serve to project particles of a material off of the vehicle. The spinner spreader includes each of a horizontal base, a plurality of outer wall members, and a rotary element. The plurality of outer wall members are vertically disposed around a circumferential perimeter of the base. The rotary element of the spinner spreader is configured to centrfigually disperse the material through rotation, while the spray nozzle is configured to spray a volume of liquid onto the material prior to dispersal of the material from the rotary element of the spinner spreader.

The spray nozzle mount is configured to adjustably direct the spray nozzle such that the volume of liquid is directed at a pathway of the material dispensed from a chute of the vehicle. It is envisioned that the material may be a rock salt of the type commonly dispersed on roads to prevent an accumulation of snow and ice. It is also envisioned that the liquid comprises a solution containing each of a beet vegetable derived substrate, sodium chloride, calcium chloride, potassium chloride, and magnisium chloride, and water. Other solutions may be substituted for the liquid, serving the purpose of preventing accumulation of snow and ice upon roads such as that produced by K-Tech Specialty Coatings, Inc. and traded under the trademark Beet Heet® Concentrate.

The mounting apertures serve as a location for removably attaching the device to either the vehicle or to one of the plurality of outer wall members of the spinner spreader. Attachment of the device may be performed with nuts and bolts or other attachment means such as wire mounting means.

In operation, the plurality of evacuation holes are directed at the pathway of the material dispensable from the chute. The vehicle is configured to selectively disperse the volume of liquid through the liquid dispenser nozzle into the first input channel. The volume of liquid is evacuated through the at least one fluid evacuation hole and onto the material as it fall or is projected from the chute, coating the material with droplets of the volume of liquid. The material then drops onto the spinner spreader and is dispersed from the rotary element onto a surface or roadway to prevent the accumulation of snow and ice. In this method, the material is wetted after being dispersed from the chute, but before coming into contact with the spinner spreader, thus, allowing the material to exit the chute as a dry rock salt, as opposed to a clumpy slush, improving the dispersability of the material from the rotary element.

Thus has been broadly outlined the more important features of the present material dispensing vehicle with material wetting apparatus so that the detailed description thereof that follows may be better understood and in order that the present contribution to the art may be better appreciated.

Numerous objects, features and advantages of the present material dispensing vehicle with material wetting apparatus will be readily apparent to those of ordinary skill in the art upon reading the following detailed description of presently preferred, but nonetheless illustrative, examples of the present material dispensing vehicle with material wetting apparatus when taken in conjunction with the accompanying drawings.

BRIEF DESCRIPTION OF THE DRAWINGS

Figures

DETAILED DESCRIPTION OF THE DRAWINGS

Figure 1:
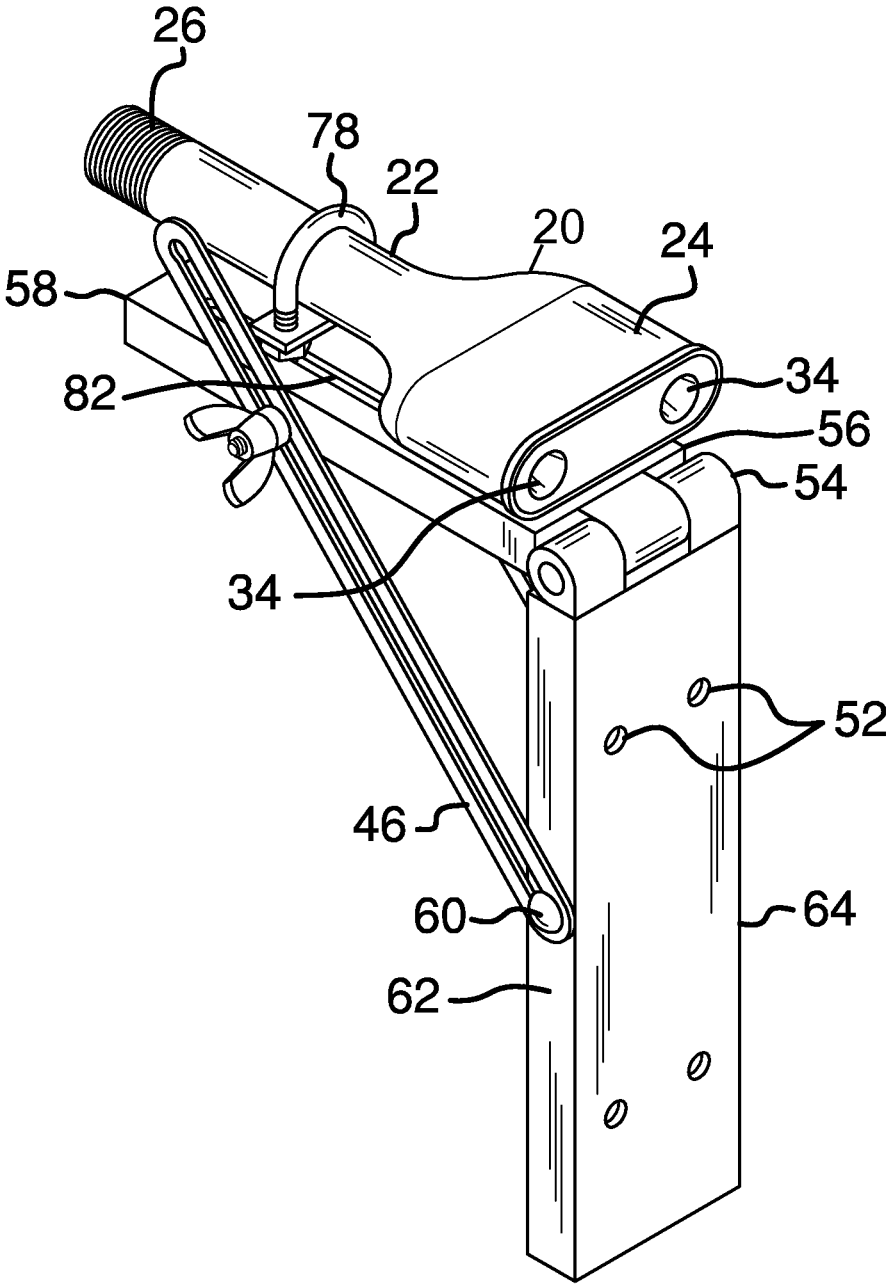
FIG. 1 is an isometric view.
Figure 2:
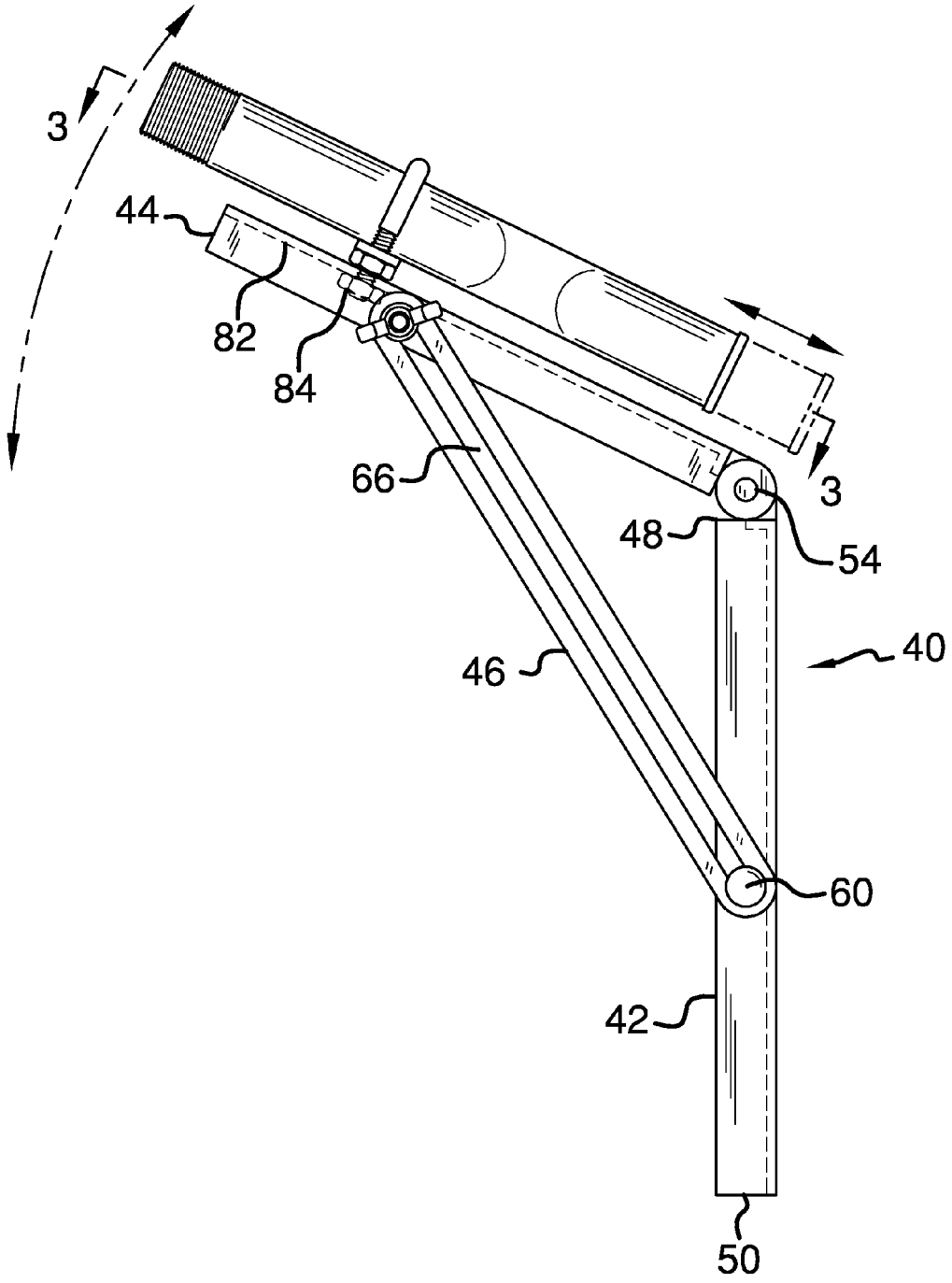
FIG. 2 is a side view.
Figure 3:
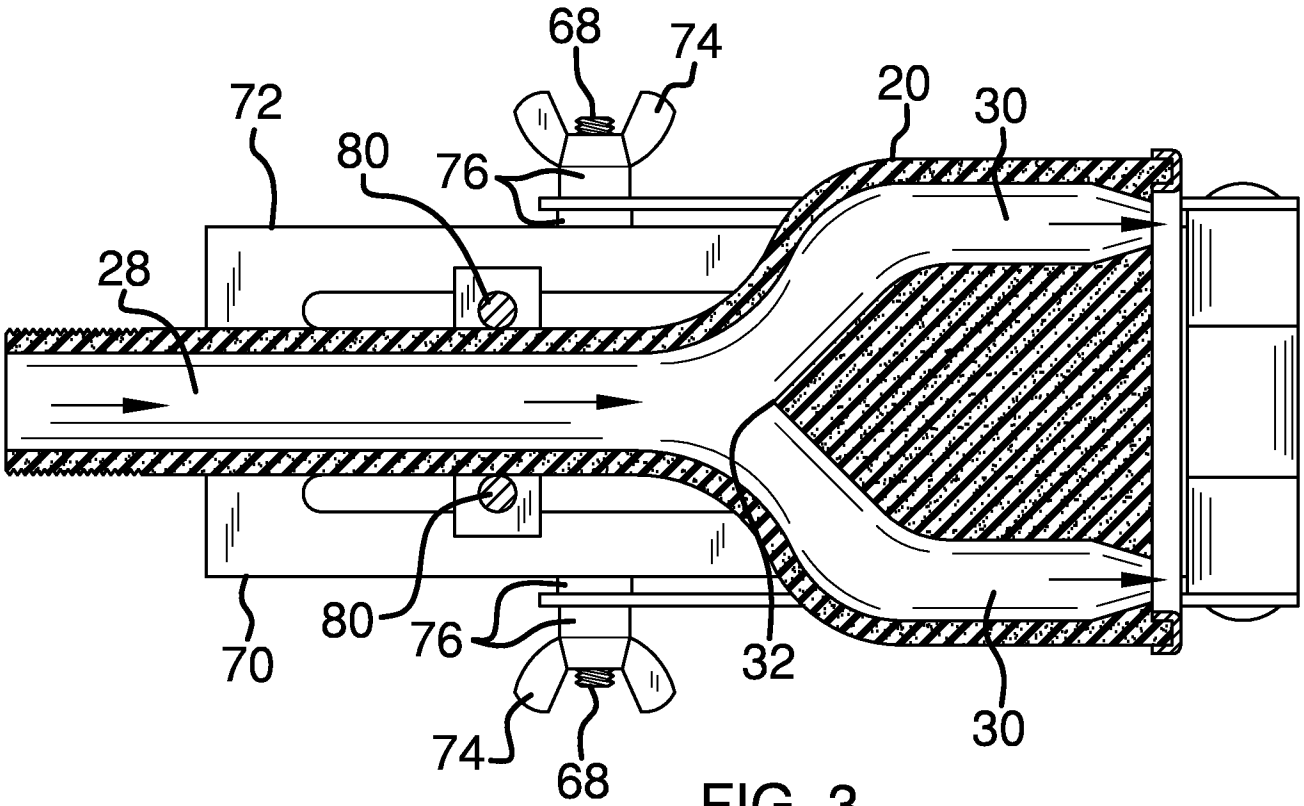
FIG. 3 is a cross-sectional view.
Figure 4:
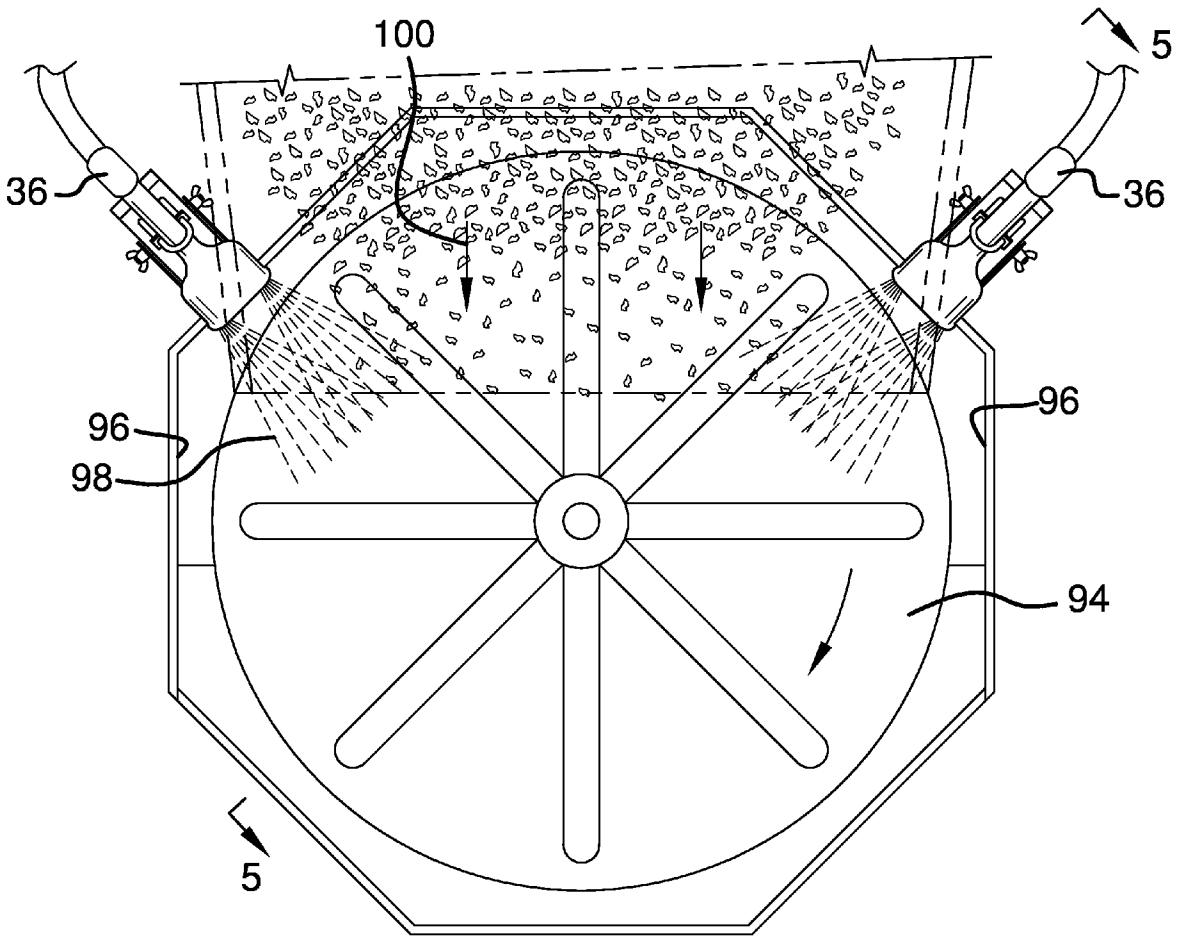
FIG. 4 is a top view of the device in use.
Figure 5:
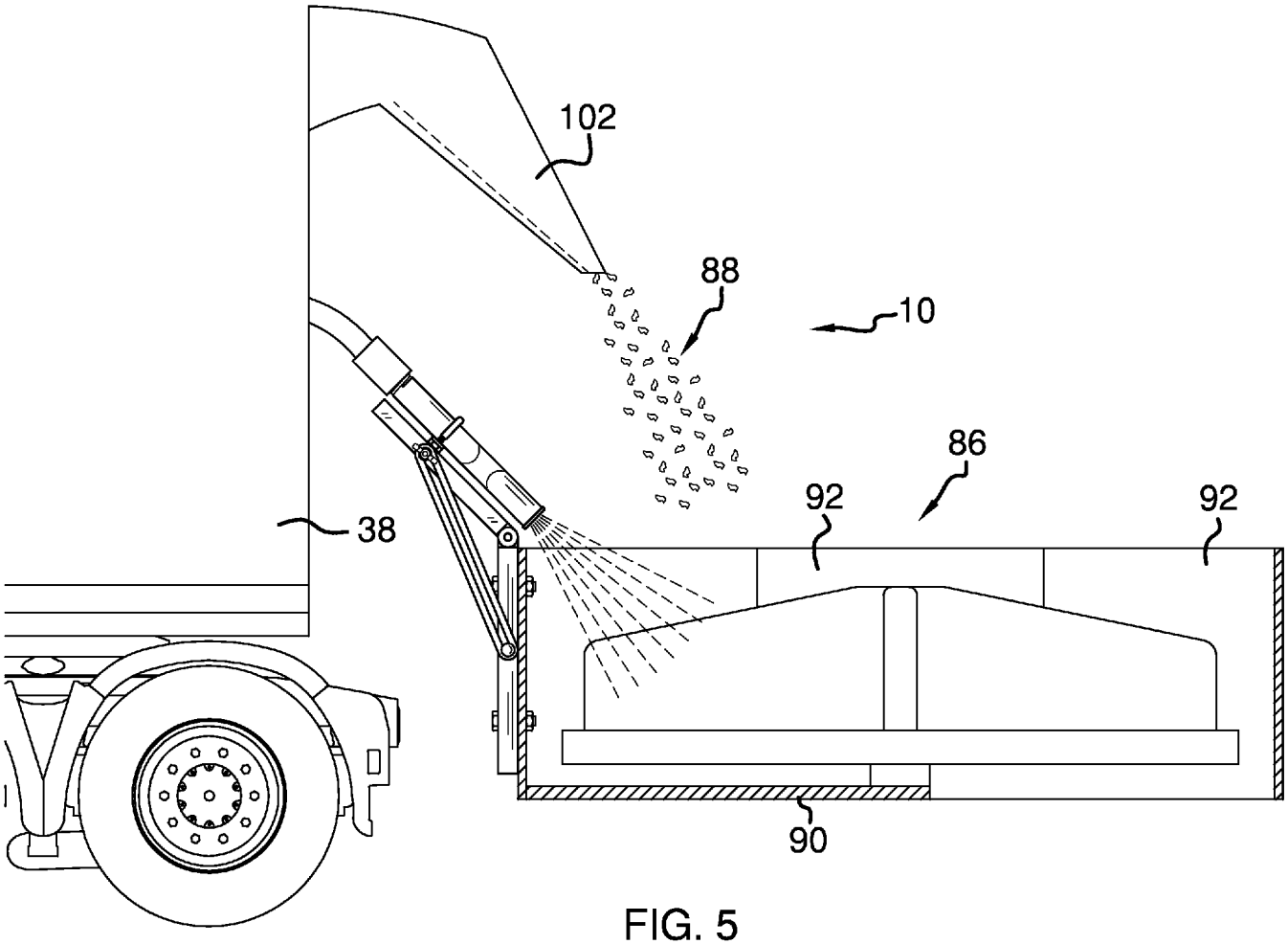
FIG. 5 is a side view of the device in use.

With reference now to the drawings, and in particular FIGS. 1 through 5 thereof, the instant material dispensing vehicle with material wetting apparatus employing the principles and concepts of the present material dispensing vehicle with material wetting apparatus and generally designated by the reference number 10 will be described.

Referring to FIGS. 1 through 5 a preferred embodiment of the present deicer dispersal apparatus is illustrated. The present device 10 includes a rubber spray nozzle 20 having an input portion 22 and an output portion 24. The input portion 22 includes each of a threaded hose attachment 26 and a first input channel 28. The first input channel 28 is furcated into a plurality of output channels 30 at a furcating point 32. The output portion 24 includes one of a fluid evacuation hole 34 for each respective one of the plurality of output channels 30. Each fluid evacuation hole 34 is configured to generate a six to eight inch wide spray. When multiple fluid evacuation holes 34 are present, the fluid evacuation holes are configured to generate multiple sprays with two inches of overlap.

The threaded hose attachment 26 of the input portion 22 is in operational communication with a liquid dispenser nozzle 36 of a vehicle 38. The output portion 24 is depicted in the figures as being flattened and obround, however other shapes are suitable such as a rounded shape.

The device 10 further includes a spray nozzle mount 40 having each of a mounting bracket 42, an alignment bracket 44, and a mirror pair of adjustment supports 46. The mounting bracket 42 has an upper end 48, a lower end 50, and a plurality of mounting apertures 52. A hinge 54 is disposed upon the upper end 48. The alignment bracket 44 has a first end 56 and a second end 58. The first end 56 is disposed upon the hinge 54. The alignment bracket 44 and the mounting bracket 42 are in operational communication at the hinge 54.

A mirror pair of pivot pins 60 is medially disposed upon each of a proximal side surface 62 and a distal side surface 64 of the mouting bracket 42. Each respective of the pair of adjustment supports 46 have an adjustment slot 66. Each respective of the pair of pivot pins 60 are disposed within one of the respective adjustment slots 66. Each respective of the pair of the adjustment supports 46 are secured to the mounting bracket 42 by one respective of the pair of pivot pins 60. Additionally, each respective of the pair of adjustment supports 46 is configured to rotate about one respective of the pair of pivot pins 60.

A mirror pair of threaded members 68 are disposed upon each of a first side surface 70 and a second side surface 72 of the alignment bracket 44. Each respective of the pair of threaded members 68 is disposed within one of the respective adjustment slots 66 of the pair of adjustment supports 46. Each of the resepective threaded members 68 is secured within one of the respective adjustment slots 66 by one respective of a pair of wing nuts 74. A pair of washers 76 is disposed between each respective wingnut 74 and the alignment bracket 44 and are retained one of the respective threaded members 68.

The device 10 further includes a U-shaped clamp 78 having a mirror pair of clamp threaded members 80. The alignment bracket 44 has a mirror pair of alignment slots 82, wherein each of the respective clamp threaded members 80 is disposed within one respective of the pair of alignment slots 82. A mirror pair of nuts 84 secure each clamp threaded member 80 within each alignment slot 82. The input portion 22 of the spray nozzle 20 is configured to fit within the clamp 78 and between each of the pair of clamp threaded members 80 and the alignment bracket 44. The spray nozzle 20 is removably disposed within the clamp 78 of the spray nozzle mount 40.

A spreader is mounted onto the vehicle and is shown in the figures as a spinner spreader 86, although other types of spreaders are envisionsed that serve to project particles of a material 88 off of the vehicle 38. The spinner spreader 86 includes each of a horizontal base 90, a plurality of outer wall members 92, and a rotary element 94. The plurality of outer wall members 92 are vertically disposed around a circumferential perimeter 96 of the base 90. The rotary element 94 of the spinner spreader 86 is configured to centrfigually disperse the material 88 through rotation, while the spray nozzle 20 is configured to spray a volume of liquid 98 onto the material 88 prior to dispersal of the material 88 from the rotary element 94 of the spinner spreader 86.

The spray nozzle mount 40 is configured to adjustably direct the spray nozzle 20 such that the volume of liquid 98 is directed at a pathway 100 of the material 88 dispensed from a chute 102 of the vehicle 38. It is envisioned that the material 88 may be a rock salt of the type commonly dispersed on roads to prevent an accumulation of snow and ice. It is also envisioned that the liquid 98 comprises a solution containing each of a beet vegetable derived substrate, sodium chloride, calcium chloride, potassium chloride, and magnisium chloride, and water. Other solutions may be substituted for the liquid 98, serving the purpose of preventing accumulation of snow and ice upon roads such as that produced by K-Tech Specialty Coatings, Inc. and traded under the trademark Beet Heet® Concentrate.

The mounting apertures 52 serve as a location for removably attaching the device to either the vehicle 38 or to one of the plurality of outer wall members 92 of the spinner spreader 86. Attachment of the device 10 may be performed with nuts and bolts or other attachment means such as wire mounting means.

What is claimed is:

1. A deicer dispersal apparatus comprising:

a spray nozzle having an input portion and an output portion, the spray nozzle having a first input channel and at least one of an output channel, the output portion having one of a fluid evacuation hole for each respective one of the at least one output channel, the input portion in operational communication with a liquid dispenser nozzle of a vehicle;

a spray nozzle mount, the spray nozzle secured to the spray nozzle mount, the spray nozzle configured to disperse a volume of a liquid at a pathway of a material dispensed from a chute of the vehicle, the spray nozzle configured to spray the liquid onto the material, the spray nozzle mount configured to adjust an orientation of the spray nozzle;

a spreader mounted onto a vehicle, the spreader configured to disperse the material;

wherein the spray nozzle mount further comprises:

a mounting bracket, an alignment bracket, and a mirror pair of adjustment supports, the mounting bracket having an upper end, a lower end, and a plurality of mounting apertures, a hinge disposed upon the upper end, the alignment bracket having a first end and a second end, the first end disposed upon the hinge, the alignment bracket and the mounting bracket in operational communication at the hinge;

a mirror pair of pivot pins medially disposed upon each of a proximal side surface and a distal side surface of the mounting bracket, each respective of the pair of adjustment supports having an adjustment slot, each respective of the pair of pivot pins disposed within one of the respective adjustment slots, each of the pair of the adjustment supports secured to the mounting bracket by one respective of the pair of pivot pins, and each respective of the pair of adjustment supports configured to rotate about one respective of the pair of pivot pins;

a mirror pair of threaded members disposed upon each of a first side surface and a second side surface of the alignment bracket, each respective of the pair of threaded members disposed within one of the respective adjustment slots of the pair of adjustment supports, each of the respective threaded members secured within one of the respective adjustment slots by one respective of a pair of wing nuts, a pair of washers disposed between each respective of the pair of wing nuts and the alignment bracket;

a U-shaped clamp having a mirror pair of clamp threaded members, the alignment bracket having a mirror pair of alignment slots, each of the respective clamp threaded members disposed within one respective of the pair of alignment slots, a mirror pair of nuts securing each clamp threaded member within each alignment slot, the input portion of the spray nozzle configured to fit within the clamp and between each of the pair of clamp threaded members and the alignment bracket.

2. The deicer dispersal apparatus of claim 1 wherein the spray nozzle is composed of a rubber polymer rated for temperatures at or below −30 degrees Fahrenheit.

3. The deicer dispersal apparatus of claim 2 wherein the rubber polymer includes an elastomer selected from the group consisting of Buna-N, Butadiene, Butyl, Chloroprene, Ethylene Propylene, Fluorosilicone, Hydrogenated Nitrile, Isoprene, and Silicone.

4. The deicer dispersal apparatus of claim 2 wherein the spray nozzle further comprises:

a threaded hose attachment disposed upon the input portion, the threaded hose attachment in operational communication with the liquid dispenser nozzle of the vehicle;

wherein the first input channel is furcated into the at least one output channel at a furcating point.

5. The deicer dispersal apparatus of claim 4 wherein the spreader is a spinner spreader, the spinner spreader configured to centrifugally disperse the material.

6. The deicer dispersal apparatus of claim 5 wherein the spinner spreader further comprises:

each of a horizontal base, a plurality of wall members, and a rotary element, the plurality of wall members vertically disposed upon the base, the rotary element of the spinner spreader configured to centrifugally disperse the material.

7. The deicer dispersal apparatus of claim 6 wherein the spray nozzle mount is mounted to one of the plurality of wall members of the spinner spreader, the spray nozzle mount secured at each of the mounting apertures.

8. The deicer dispersal apparatus of claim 7 wherein the material is a salt.

9. The deicer dispersal apparatus of claim 8 wherein the liquid comprises each of a beet vegetable derived substrate, sodium chloride, calcium chloride, potassium chloride, and magnisium chloride, and water.

10. A deicer dispersal apparatus comprising:

a rubber spray nozzle having an input portion and an output portion, the input portion having each of a threaded hose attachment and a first input channel, the first input channel furcated into a plurality of output channels at a furcating point, the output portion having one of a fluid evacuation hole for each respective one of the plurality of output channels, the threaded hose attachment in operational communication with a liquid dispenser nozzle of a vehicle;

a spray nozzle mount having each of a mounting bracket, an alignment bracket, and a mirror pair of adjustment supports, the mounting bracket having an upper end, a lower end, and a plurality of mounting apertures, a hinge disposed upon the upper end, the alignment bracket having a first end and a second end, the first end disposed upon the hinge, the alignment bracket and the mounting bracket in operational communication at the hinge;

a mirror pair of pivot pins medially disposed upon each of a proximal side surface and a distal side surface of the mouting bracket, each respective of the pair of adjustment supports having an adjustment slot, each respective of the pair of pivot pins disposed within one of the respective adjustment slots, each of the pair of the adjustment supports secured to the mounting bracket by one respective of the pair of pivot pins, and each respective of the pair of adjustment supports configured to rotate about one respective of the pair of pivot pins;

a mirror pair of threaded members disposed upon each of a first side surface and a second side surface of the alignment bracket, each respective of the pair of threaded members disposed within one of the respective adjustment slots of the pair of adjustment supports, each of the resepective threaded members secured within one of the respective adjustment slots by one respective of a pair of wing nuts, a pair of washers disposed between each respective wingnut and the alignment bracket;

a U-shaped clamp having a mirror pair of clamp threaded members, the alignment bracket having a mirror pair of alignment slots, each of the respective clamp threaded members disposed within one respective of the pair of alignment slots, a mirror pair of nuts securing each clamp threaded member within each alignment slot, the input portion of the spray nozzle configured to fit within the clamp and between each of the pair of clamp threaded members and the alignment bracket;

the spray nozzle removably disposed within the clamp of the nozzle mount, the spray nozzle mount configured to adjustably direct the spray nozzle, the spray nozzle configured to disperse a volume of a liquid at a pathway of a material dispensed from a chute of the vehicle;

a spinner spreader mounted onto the vehicle, the spinner spreader having each of a horizontal base, a plurality of outer wall members, and a rotary element, the plurality of outer wall members vertically disposed upon the base, the rotary element of the spinner spreader configured to centrfigually disperse the material, the spray nozzle configured to spray the liquid onto the material prior to dispersal of the material from the spinner spreader;

wherein the spray nozzle mount is mounted to one of the plurality of outer wall members of the spinner spreader, the spray nozzle mount secured at each of the mounting apertures.

11. The deicer dispersal apparatus of claim 10 wherein the material is a salt.

12. The deicer dispersal apparatus of claim 11 wherein the liquid comprises a beet vegetable derived substrate, sodium chloride, calcium chloride, potassium chloride, and magnisium chloride, and water.

* * * * *